US005158050A

United States Patent [19]

Hawkins et al.

[11] Patent Number: 5,158,050

[45] Date of Patent: Oct. 27, 1992

[54] METHOD AND SYSTEM FOR CONTROLLING THE ENERGIZATION OF AT LEAST ONE GLOW PLUG IN AN INTERNAL COMBUSTION ENGINE

[75] Inventors: Jeffrey S. Hawkins, Burbank, Calif.; David P. Tasky, Auburn Hills, Mich.; Juhan Telmet, Sterling Heights, Mich.

[73] Assignee: Detroit Diesel Corporation, Detroit, Mich.

[21] Appl. No.: 757,724

[22] Filed: Sep. 11, 1991

[51] Int. Cl.[5] ..... F02P 19/02

[52] U.S. Cl. ..... 123/145 A; 123/179.21

[58] Field of Search ..... 123/179.21, 145 A; 219/497, 507, 508, 509

[56] References Cited

U.S. PATENT DOCUMENTS

| | | | |
|---|---|---|---|
| 4,088,109 | 5/1978 | Woodruff et al. | 123/179.21 |
| 4,137,885 | 2/1979 | VanOstrom | 123/179.21 |
| 4,177,785 | 12/1979 | Sundeen | 173/179.21 |
| 4,307,688 | 12/1984 | Steele | 123/179.21 |
| 4,444,160 | 4/1984 | Steele | 123/179.21 |
| 4,452,191 | 6/1984 | Steele | 123/179.21 |
| 4,487,169 | 12/1984 | Slezak et al. | 123/179.21 |
| 4,512,295 | 4/1985 | Hanson | 123/145 A |
| 4,552,102 | 11/1985 | Egle | 123/145 A |
| 4,594,974 | 6/1986 | Norwak | 123/145 A |
| 4,701,596 | 10/1987 | Schirmer et al. | 123/179.21 |
| 4,726,333 | 2/1988 | Verheyen | 123/145 A |
| 4,858,576 | 8/1989 | Jeffries et al. | 123/145 A |
| 4,934,349 | 6/1990 | Demizu | 123/179.21 |

OTHER PUBLICATIONS

Bennethum, J. E. AND Srinivasan, N., *Detroit Diesel Allison's Two-Stroke Cycle Compression Ignited Alcohol Engines*, International Symp. on Alcohol Fuels, Tech. 1, 38 (Jan. 1984).

Miller, Stanley P. et al., "Development Status of the Detroit Diesel Corporation Methol Engine", SAE Technical Paper, Sep. 10-13, 1990.

*Primary Examiner*—Willis R. Wolfe

*Attorney, Agent, or Firm*—Brooks & Kushman

[57] ABSTRACT

A method and system are provided for controlling the energization of at least one glow plug in an internal combustion engine wherein a solid state drive circuit, including a semiconductor switch, is utilized for applying an energizing current to the at least one glow plug from a voltage source based on a control signal to electrically heat the at least one glow plug. The control signal is preferably a 50 Hz switched ground duty cycle signal from an electronic control module (ECM). Based on the duty cycle input, the drive circuit for each of the glow plugs supplies current from a main feed bus. A glow plug current monitoring circuit is provided for each of the glow plugs to detect whenever an open or short circuit condition appears in any of the glow plugs. The semiconductor device preferable is a current sensing type of MOSFET called a SENSEFET. Each SENSEFET internally monitors individual current draw of its respective glow plug to verify its proper operation. Upon detecting an out-of-limit condition of a glow plug, the drive circuit for the particular glow plug is disabled to protect the drive circuit and a diagnostic circuit in enabled to indicate this fault mode through an indicator lamp and starter inhibit relay driver circuit. Because the drive circuit for that particular glow plug is disabled, it does not sustain damage and resumes proper operation when a "good" glow plug is installed for the "bad" glow plug.

18 Claims, 3 Drawing Sheets

VEHICLE SUPPLY
SENSEFET
SIGNAL CONDITIONING AND GATE DRIVE CIRCUITS
TIMER FOR PRE-HEAT
DIAGNOSTIC CIRCUITS
GLOW PLUG CURRENT MONITORING CIRCUITS
STARTER INHIBIT RELAY
FAULT INDICATOR LAMPS
IGNITION
PWM INPUT
'ON'
'OFF'
ECM
1L
2L
3L
1R
2R
3R
10
14
22
24
26
28
30
32
34
36
38
40
42
44

METHOD AND SYSTEM FOR CONTROLLING THE ENERGIZATION OF AT LEAST ONE GLOW PLUG IN AN INTERNAL COMBUSTION ENGINE

TECHNICAL FIELD

This invention relates to methods and systems for controlling energization of at least one glow plug in an internal combustion engine of a vehicle including a voltage source and, in particular, to methods and systems for controlling energization of a plurality of glow plugs in an internal combustion engine of a vehicle having a voltage source.

BACKGROUND ART

To facilitate diesel engine starting, particularly with cold ambient temperatures, the combustion chamber of each of the engine cylinders is generally preheated by an electrically energized glow plug adapted to be threaded into the engine block in communication with the combustion chamber. Upon the electrical energization thereof, the temperature of each of the glow plug heater elements is raised to preheat the corresponding combustion chamber prior to engine "crank". The period of time a glow plug heater element is energized prior to engine crank, the preheat period, is determined by engine temperature and glow plug heater element energization potential magnitude (i.e. the lower the temperature and/or the lower the glow plug heater element energization potential magnitude, the longer the preheat period required).

With many glow plug energization control systems, the glow plug heater elements are energized at rated energizing potential. Although this rated glow plug heater element energization potential prevents premature failure as a result of overheating, the period of preheat before engine crank may be of the order of one or two minutes or longer with colder ambient temperatures. To substantially reduce the preheat period the glow plug heater elements may be energized at greater the rate of energizing potential. With glow plug heater element energization at greater than rated potential, however, it is necessary that the heater elements be cyclically energized for successive periods of time just long enough to increase the temperature thereof to a predetermined maximum. Systems of this type are disclosed and described in U.S. Pat. Nos. 4,137,885 and 4,177,785. Other glow plug energization systems, generally of the type noted above, are disclosed in U.S. Pat. Nos. 4,088,109, 4,307,688, 4,444,160 and 4,452,191.

As noted in U.S. Pat. No. 4,726,333 in order to ignite an alternative fuel, such as alcohol, in a diesel engine, the fuel must be heated before or during compression. Glow plugs conveniently provide heat, but have a relatively short life in continuous applications. Such glow plugs must be accurately controlled to prevent overheating, which leads to open circuiting.

U.S. Pat. No. 4,512,295 discloses a system for protecting against the enlargement of diesel glow plug tips. Separate protective devices are connected in series to its individual glow plugs, which open in response to current through the protective device to a value corresponding to a short of the heating element in the tip of the glow plug.

U.S. Pat. No. 4,487,169 discloses an electronic control unit for an internal combustion engine wherein a duty cycle rate generator alternately connects and disconnects a source of DC voltage to the glow plugs above the present value at a duty cycle rate which ranges from 0 to 100% and which depends on the voltage level of the source of DC voltage.

One approach to control glow plug energization is to turn the glow plugs on and off through the use of a electromechanical relay. The number of on/off cycles required in an operation such as an urban bus operation, however, can quickly exceed the life of the relay so that periodic expensive replacement is required.

Consequently, there is a need for a method and system for controlling the energization of at least one glow plug to provide fast warmup while minimizing the chance of an overtemperature condition for the glow plug. Also, there is a need to have a method and system to control the energization of the glow plug, which is not only reliable, but also ensures a long life for the system which controls the energization of the glow plug.

SUMMARY OF THE INVENTION

An object of the present invention is to provide a method and system for controlling the energization of at least one glow plug in an internal combustion engine of a vehicle which provides a fast warmup, while minimizing the chance of an overtemperature condition in the at least one glow plug.

Another object of the present invention is to provide a method and solid state system for controlling the energization of at least one glow plug in an internal combustion engine of a vehicle wherein the solid state system is protected from a shorted glow plug.

Another object of the present invention is to provide a method and system for controlling energization of at least one glow in an internal combustion engine of a vehicle including a voltage source wherein the method and system are versatile in that either a first or a second voltage supply can be used, even though the at least one glow plug may be rated at a single voltage.

In carrying out the above objects and other objects of the present invention, a method is provided by controlling the energization of at least one glow plug in an internal combustion engine of a vehicle, including a voltage source having a predetermined voltage. The method includes the steps of monitoring the temperature of the engine and generating an input control signal based on the temperature of an engine. The method further includes the step of providing a semiconductor switch to supply an energizing current to the at least one glow plug from the voltage source based on the control signal to thereby electrically heat the at least one glow plug. The method includes the steps of generating a feedback signal as a function of the energizing current, determining an electrical property of the at least one glow plug based on the feedback signal, and preventing the application of the energizing current to the at least one glow plug in an out-of-limit condition of the electrical property.

Preferably, the semiconductor switch performs the step of generating the feedback signal and the semiconductor switch is a current sensing type of MOSFET called a SENSEFET.

Also, preferably, the method further includes the step of determining the predetermined voltage of the voltage source and the input control signal has a duty cycle which is based on the predetermined voltage.

Preferably, the input signal is conditioned so that the energization current is based on the conditioned control signal.

A system for carrying out each of the above method steps is also provided.

The advantages accruing to the use of the method and system of the present invention are numerous. For example, the current self-regulation scheme provided by the semiconductor device provides fast warmup while minimizing the chance of overtemperature of its associated controlled glow plug. Also, the method and system provide an effective way of protecting the solid state drive circuitry of each glow plug from a shorted glow plug. In this way, the glow plug output drivers are inhibited and normal operation is only resumed when an out-of-limit condition is removed.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
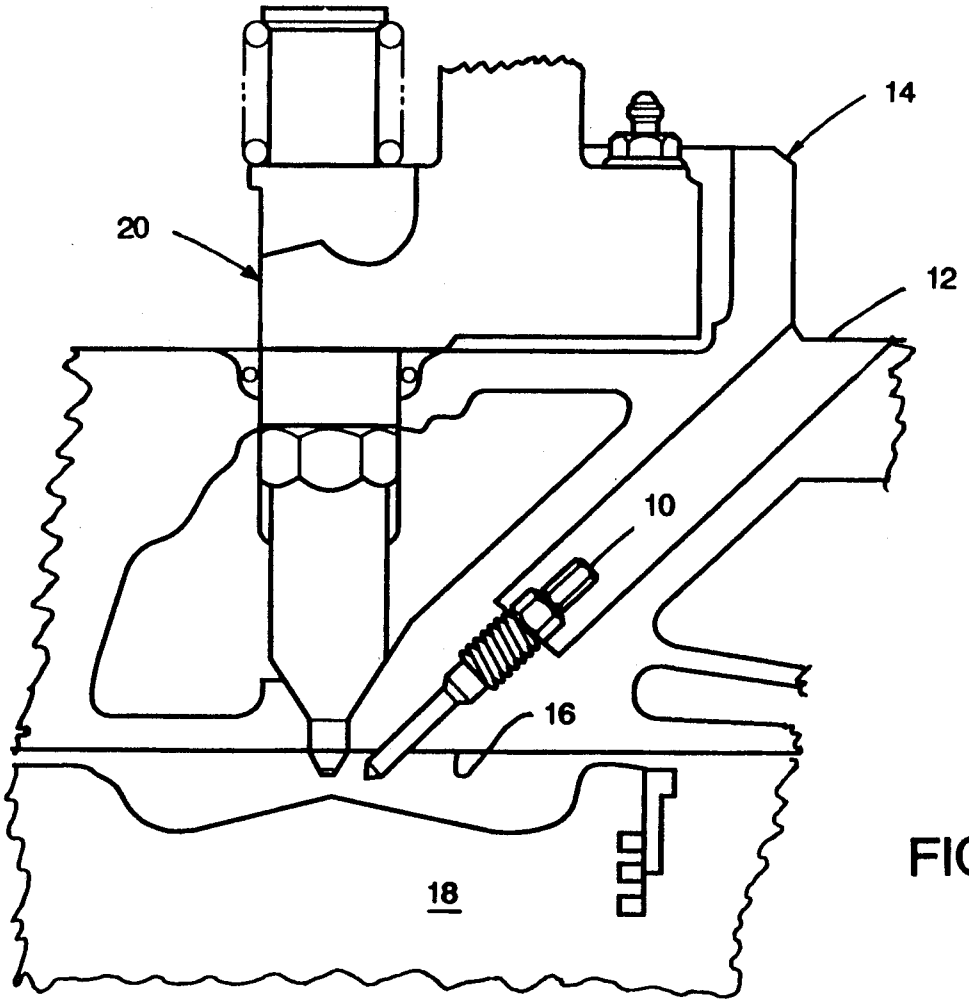
FIG. 1 is a side view illustrating the relative position of a glow plug with respect to an electronic unit injector in an internal combustion engine such as a methanol-fueled engine.

Referring now to the drawing figures, there is illustrated in FIG. 1 a glow plug 10 threaded into the engine block 12 of an internal combustion engine, generally indicated at 14, in communication with a combustion chamber 16. Upon electrical energization of the glow plug 10, the temperature of the glow plug heater element is raised to preheat the combustion chamber 16 prior to engine crank. The combustion chamber 16 is at least partially defined by a piston 18.

Figure 2:
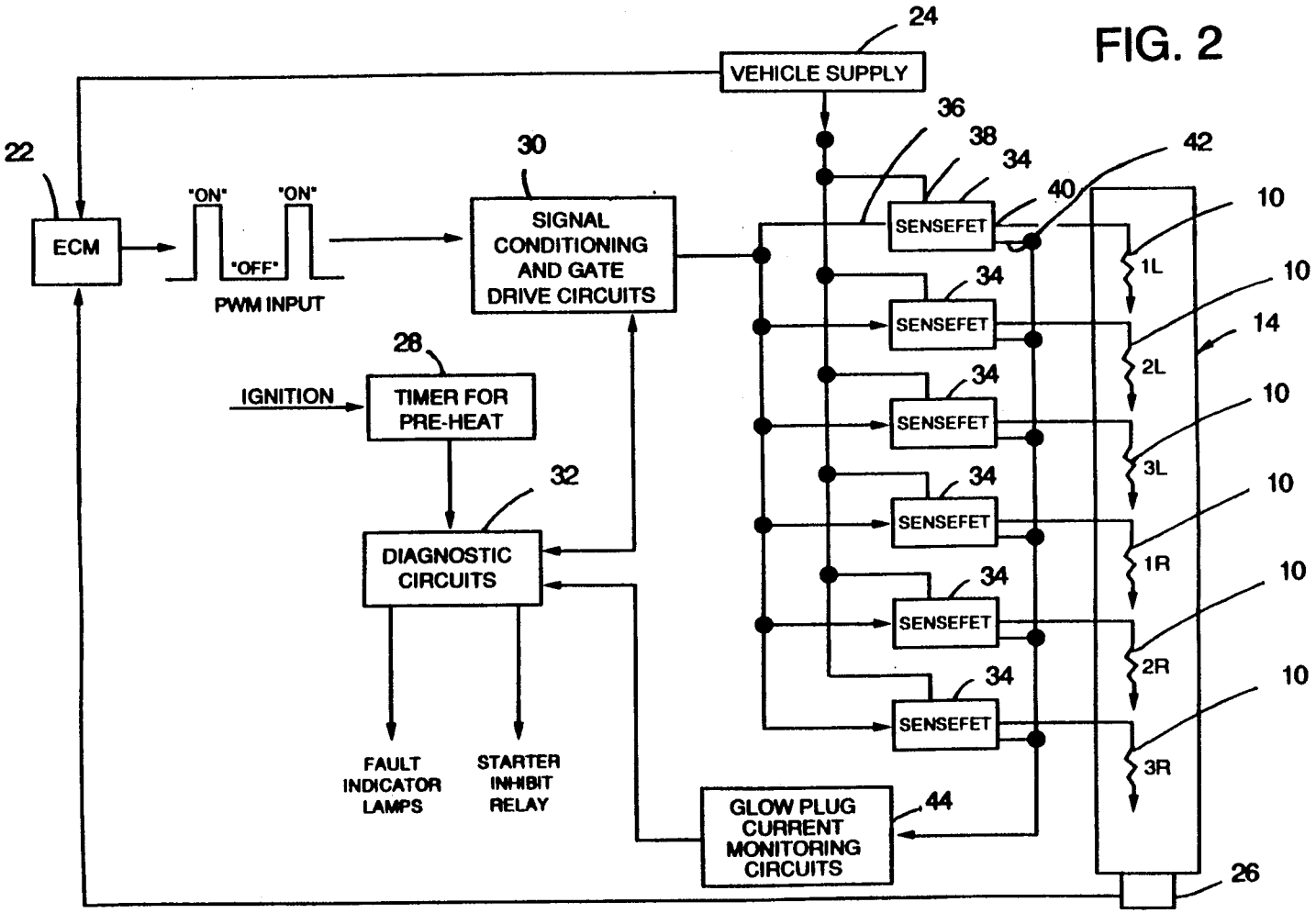
FIG. 2 is a block schematic diagram, illustrating the method and system of the present invention.

An electronic unit injector, generally indicated at 20, is controlled by an electronic control module (ECM), as indicated at 22 in FIG. 2, to inject a quantity of methanol fuel into the combustion chamber 16 in a precise timing fashion. Preferably, the control system illustrated in FIG. 2 is mounted on a cold plate, together with the ECM 22 in order to cool the circuitry of the system for relatively high reliability and life.

Referring now to FIG. 2, there is illustrated the method and system for controlling the energization of six glow plugs 10, threadedly mounted within the engine 14.

In general, hot surface ignition assist provided by the glow plugs 10 is used only for cold start and cold engine operating stability. Under relatively limited glow plug duty cycle operation, glow plug life is greatly extended. However, there is a need for low-load, low-speed glow plug operation to ensure reliable auto-ignition in a warm engine following a sharp no-load deceleration, or when heavy accessory load is quickly applied while the engine is at idle. In general, auto ignition without glow plug operation in a warm engine is strong across all speeds and loads under steady state operation, or any of the typical transient emission cycles.

Figure 3:
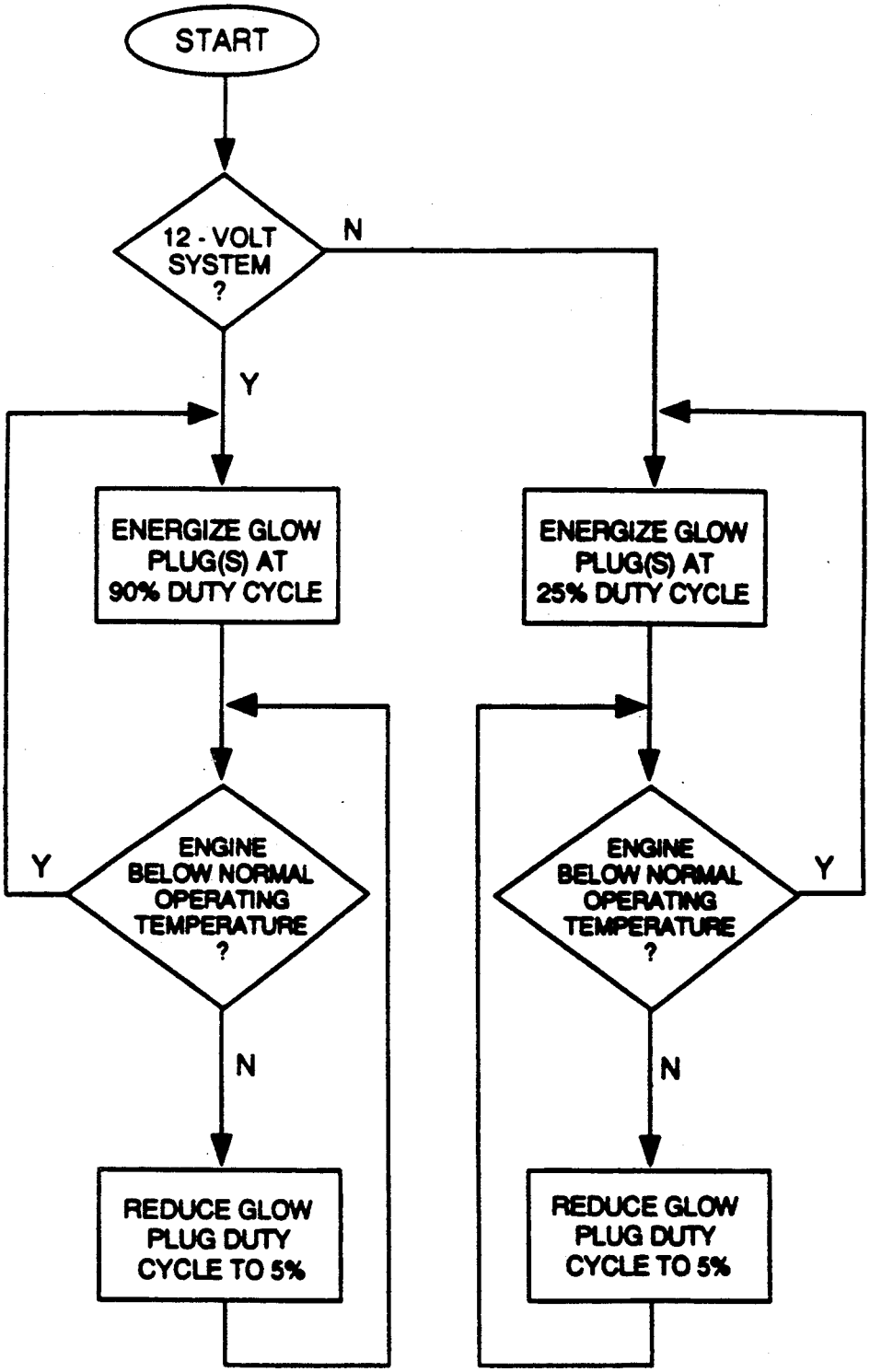
FIG. 3 is a block diagram flowchart illustrating the control logic of the electronic control module (ECM) of FIG. 2.

Referring now to FIG. 3 in combination with FIG. 2, the ECM 22 provides a 50 Hz pulse width modulated (PWM) signal having a duty cycle, which varies depending on the voltage level of the vehicle supply voltage 24. This allows the method and system of the present invention to be versatile in that either a 12 volt or 24 volt supply can be used. In either event, 12 volt glow plugs may be used. This provides an advantage for motor vehicles, such as buses, which use a primary 24 volt electrical charging system with a splitter for the 12 volt side which is typically only used for lights. This eliminates the necessity for a separate 12 volt alternator and independent battery to supply the necessary current for starting and idle operation without running down the 12 volt side batteries.

As illustrated in FIG. 3, when a 24 volt supply is used, a maximum duty cycle of 25% is permitted. This provides the same maximum glow plug temperature as 12 volts on 90% of the time. If desired, the ECM 22 could be programmed to operate the glow plugs 10 at a duty cycle dependent on engine speed and load, as well as coolant temperature, as discussed in greater detail immediately hereinbelow.

The ECM 22 senses the cooling temperature through a coolant temperature sensor 26 so that as long as the engine 14 is below its normal operating temperature, the glow plugs 10 are energized at their respective duty cycles. After the engine reaches its normal operating temperature, the glow plug duty cycle is reduced to 5% as will be described hereinbelow.

Preferably, upon initial application of ignition voltage, there is an approximately 40 second time delay for engine warmup in which the starter relay is disabled and an indicator lamp is enabled, indicating that the engine is warming up, as indicated at block 28.

The pulse width modulated input control signal, as provided by the ECM 22, is received by signal conditioning and gate drive circuits 30. Conditioning circuits contained within block 30 include subtraction circuitry, so that when a 5% duty cycle signal is received from the ECM 22, the output through the glow plugs 10 is substantially 0. However, this 5% duty cycle signal is provided for diagnostic circuits 32 which, in turn, powers fault indicator lamps and a starter inhibit relay.

During normal operation, the indicator lamps are "off", the starter relay is "on" with the starter "engaged". During engine warmup, the indicator lamps are "on", the starter relay is "off", with the starter "disengaged". In a faulty condition of one or more of the glow plugs 10, the indicator lamps are "on", the starter relay is "off", and the starter is "disengaged".

In general, a separate drive circuit, including a current sensing type of MOSFET called a SENSEFET is provided to control the energization current to each glow plug 10. Each drive circuit drives its respective glow plug based on the conditioned pulse width modulated (PWM) input control signal from the ECM 22. Each SENSEFET 34 is capable of providing, for example, 25 amperes continuous to its respective glow plug 10.

Preferably, each SENSEFET 34 is made by International Rectifier Corporation of California, under Model No. 1RCZ44. The SENSEFET 34 has a gate input 36, a current supply input 38, an output 40 and a current feedback output 42 which provides a feedback signal as a function of the energizing current to its respective glow plug 10.

Glow plug current monitoring circuits 44 are provided to monitor the current feedback signal from each of the SENSEFETS 34. The glow plug current monitoring circuits 44, in turn, provide a signal to the diagnostic circuits 32, based on the level of current flowing through each of the SENSEFETS 34 so that the diagnostic circuitry 32 can detect burned or open plugs, faulty input commands and low voltage conditions. The fault modes are indicated through indicator lamps and a starter inhibit relay driver circuit. Disabling the starter relay will not allow the vehicle to start as long as a faulty condition is present.

When a shorted glow plug condition is detected by the diagnostic circuits 32, a signal is provided to the corresponding gate drive circuits of block 30 to prevent the application of the conditioned control signal to the gate input 36 of its corresponding SENSEFET 34. It is understood that each SENSEFET 34 is separately controlled so that the other glow plugs may still be energized.

In general, the system is capable of detecting any of the glow plugs 10 which has either an open or short circuit. The system is also capable of communicating the resultant diagnostic information generated by the diagnostic circuits 32 to indicator lamps and a starter relay. The system also is capable of detecting when the 50 Hz switched ground duty cycle signal is not being received and communicating the resultant diagnostic information to the indicator lamps and the starter relay.

The system, through the SENSEFETS 34, is internally protected to continually monitor overcurrent conditions existing at the SENSEFETS 34. In the event of an overcurrent condition or a short-to-ground, each SENSEFET 34 is inhibited and normal operation is resumed when the short-to-ground is eliminated.

When a 24 volt vehicle supply is utilized, preferably an independent ground wire attached to the vehicle frame, main ground stud or battery negative terminal is preferred.

While the best mode for carrying out the invention has been described in detail, those familiar with the art to which this invention relates will recognize various alternative designs and embodiments for practicing the invention as defined by the following claims.

What is claimed is:

1. A method for controlling the energization of at least one glow plug in an internal combustion engine of a vehicle including a voltage source having a predetermined voltage, the method comprising the steps of:

monitoring the temperature of the engine;

generating an input control signal based on the temperature of the engine;

providing a semiconductor switch to apply an energizing current to the at least one glow plug from the voltage source based on the control signal to thereby electrically heat the at least one glow plug;

generating a feedback signal as a function of the energizing current;

determining an electrical property of the at least one glow plug based on the feedback signal; and preventing the application of the energizing current to the at least one glow plug in an out-of-limit condition of the electrical property.

2. The method of claim 1 further comprising the steps of conditioning the input control signal to obtain a conditioned control signal, the energizing current being based on the conditioned control signal; and providing a signal indicating the out-of-limit condition of the electrical property.

3. The method of claim 1 wherein the step of generating the feedback signal is accomplished by the semiconductor switch.

4. The method of claim 3 wherein the semiconductor switch is a metal oxide silicon field effect transistor.

5. The method of claim 4 wherein the metal oxide silicon field effect transistor is a SENSEFET for providing the feedback signal.

6. The method of claim 1 wherein a plurality of glow plugs are controlled and wherein the step of sensing includes the step of sensing the energizing current to each of the plurality of glow plugs.

7. The method of claim 1 wherein the input control signal has a duty cycle.

8. The method of claim 7 further comprising the step of determining the predetermined voltage of the voltage source and wherein the duty cycle of the input control signal is based on the predetermined voltage.

9. The method of claim 8 wherein the duty cycle of the input control signal is substantially constant.

10. A system for controlling the energization of at least one glow plug in an internal combustion engine of a vehicle including a voltage source having a predetermined voltage, the system comprising:

means for monitoring the temperature of the engine;

means for generating an input control signal based on the temperature of the engine;

a drive circuit including a semiconductor switch for applying an energizing current to the at least one glow plug from the voltage source based on the control signal to electrically heat the at least one glow plug;

means for generating a feedback signal as a function of the energizing current;

means for determining an electrical property of the at least one glow plug based on the feedback signal; and means for disabling the drive circuit to prevent the application of the energizing current to the at least one glow plug in an out-of-limit condition of the electrical property.

11. The system of claim 10 further comprising means for conditioning the input control signal to obtain a conditioned control signal, the energizing current being based on the conditioned control signal; and means for generating a signal indicating the out-of-limit condition of the electrical property.

12. The system of claim 10 wherein the means for generating the feedback signal is defined by the semiconductor switch.

13. The system of claim 12 wherein the semiconductor switch is a metal oxide silicon field effect transistor.

14. The system of claim 13 wherein the metal oxide silicon field effect transistor is a SENSEFET for providing the feedback signal.

15. The system of claim 10 wherein a plurality of glow plugs are controlled.

16. The system of claim 10 wherein the input control signal has a duty cycle.

17. The system of claim 16 further comprising means for determining the predetermined voltage of the voltage source and wherein the duty cycle of the input control signal is based on the predetermined voltage.

18. The system of claim 17 wherein the duty cycle of the input control signal is substantially constant.

* * * * *